US005823002A

United States Patent [19]

Jeong

[11] Patent Number: 5,823,002

[45] Date of Patent: Oct. 20, 1998

[54] AIR CONDITIONER AND METHOD THEREFOR

[75] Inventor: Eui-Jin Jeong, Suwon, Rep. of Korea

[73] Assignee: Samsung Electronics Co., Ltd., Suwon, Rep. of Korea

[21] Appl. No.: 764,268

[22] Filed: Dec. 12, 1996

[30] Foreign Application Priority Data

Dec. 13, 1995 [KR] Rep. of Korea ..... 95-49388

[51] Int. Cl.[6] ..... F25B 49/00

[52] U.S. Cl. ..... 62/131; 62/180; 318/266; 318/286; 340/686

[58] Field of Search ..... 62/131, 180, 186, 62/408, 409, 262; 340/524, 686; 318/264, 265, 266, 267, 282, 286, 468; 454/236, 239, 296, 324; 236/49.3

[56] References Cited

U.S. PATENT DOCUMENTS

| | | | |
|---|---|---|---|
| 4,362,975 | 12/1982 | Orsini | 318/293 |
| 4,533,905 | 8/1985 | Leivenzon et al. | 340/524 |
| 4,882,913 | 11/1989 | LaCount, II et al. | 62/409 |
| 5,461,875 | 10/1995 | Lee et al. | 62/131 X |

*Primary Examiner*—Harry B. Tanner
*Attorney, Agent, or Firm*—Burns, Doane, Swecker & Mathis, L.L.P.

[57] ABSTRACT

This invention involves an air conditioner and method of its operation capable of preventing undesirable power consumption, prolonging the useful life of its parts, and improving operational efficiency through prevention of its malfunction. For an air conditioner having an intake inlet for taking in an indoor air, a heat-exchanger for heating-exchanging the indoor air, a discharge outlet to discharge the heat-exchanged air, and a discharge outlet door to be closed for preventing dusts or foreign substances from passing through the discharge outlet in a stand-by mode of the air conditioner, which door is to be opened for discharging the heat-exchange air in an operational mode of the air conditioner, the air conditioner includes a control unit for generally controlling air conditioning, a door motor driving unit for controlling a drive for the door motor such that, in response to a control signal from the control unit, the door is moved upward or downward to open or close the discharge outlet, a door position detecting unit for detecting a current position of the door and for providing a detection signal to the control unit, and a voltage switching unit for controlling a driving voltage to be supplied to the door position detecting unit in response to either fully up or down moved states of the door.

8 Claims, 7 Drawing Sheets

AIR CONDITIONER AND METHOD THEREFOR

BACKGROUND OF THE INVENTION

1. Field of the Invention

The present invention relates to an air conditioner and more particularly, to an air conditioner and method therefor aimed to prevent undesirable power consumption by controlling a voltage applied to a door position detecting unit for detecting vertically moved states of a discharge outlet.

2. Description of the Prior Art

A conventional air conditioner includes a suction inlet for introducing an indoor air into a main body of the air conditioner, a heat-exchanger for heat-exchanging the sucked indoor air, and a discharge outlet for discharging indoors the heat-exchanged air. Furthermore, the discharge outlet is provided with a discharge outlet door which serves to prevent dusts or foreign substances in the room from passing through the discharge outlet when the air conditioner is at stand-by mode.

However, the conventional air conditioner at the operational mode always supplies a drive voltage to a door open sensor for detecting if the door is open, and a door close sensor for detecting if the door is closed, which acts as a cause of undesirable power consumption and consequently results in the shortened life time of the sensors. Also, malfunction of the above sensors due to a refraction of the light or any impact from the external during a normal or a stand-by mode of the air conditioner acts as causes of reduction in the operational efficiency of the air conditioner.

SUMMARY OF THE INVENTION

Therefore, it is an object of the present invention to provide an air conditioner and method therefor by which a reduced power consumption of the product, a prolonged life time of the parts, easier maintenance and the prevention of malfunction of the product can be effected.

The above objects are accomplished by an air conditioner including a suction inlet for taking in an indoor air, a heat-exchanger for heat-exchanging the indoor air, a discharge outlet formed to discharge indoors the heat-exchanged air, and a discharge outlet door to be closed for preventing dusts or foreign substances from passing through the discharge outlet at a stand-by mode of the air conditioner, and to be opened for discharging indoors the heat-exchanged air at an operational mode of the air conditioner, the air conditioner comprising:

control means for generally controlling an air conditioning;

door motor driving means for controlling a door motor drive such that, in response to a control signal from the control means, the door is moved upward or downward to open or close a discharge outlet;

door position detecting means for detecting a current position of the door which is moved upward or downward with the drive of the door motor and providing a detection signal to the control means; and voltage switching means for controlling a driving voltage to be supplied to the door position detecting means in response to either fully up or down moved states of the door.

According to another aspect of the present invention, it is provided a method for conditioning an indoor air, the method comprising the steps of:

initializing an air conditioner;

moving downward a door for opening a discharge outlet in response to an operation command for the air conditioner, applying a driving voltage to the door position detecting means for detecting the moved state of the door during a down movement of the door;

shutting off supply of the driving voltage to the door position detecting means in case of suspension of the door motor drive made when the discharge outlet is fully opened;

performing an air conditioning in response to pre-set air conditioning conditions;

closing the discharge outlet by moving upward the door through the door motor drive when the air conditioning is finished; and entering stand-by mode after shutting off supply of the driving voltage which is provided to the door position detecting means in case of suspension of the door motor drive made when the discharge outlet is fully closed.

BRIEF DESCRIPTION OF THE DRAWINGS

Other objects and aspects of the invention will become apparent from the following description of embodiments with reference to the accompanying drawings in which.

DETAILED DESCRIPTION OF THE PREFERRED EMBODIMENT

The preferred embodiment according to the present invention will now be described in detail in accordance with the accompanying drawing.

Figure 1:
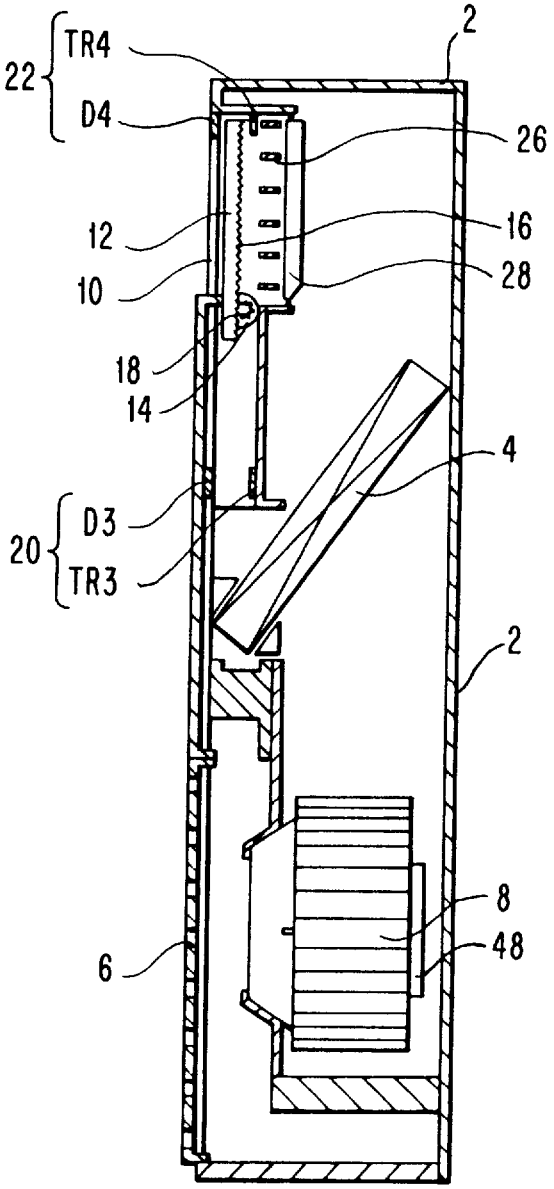
FIG. 1 is a sectional view of an air conditioner in accordance with an embodiment of the present invention.

As shown in FIG. 1, a heat-exchanger 4 is disposed at an approximately middle portion within an indoor unit 2.

The heat-exchanger 4 is provided at a lower portion thereof with an indoor fan 8 for circulating a room air such that the room air is introduced into the indoor unit 2 through a suction inlet 6 and heat-exchanged.

At an upper portion of the indoor unit 2, are formed a discharge outlet 10 for discharging indoors the heat-exchanged air and a door 12 which is moved upward and downward to open or close the discharge outlet 10. The door 12 has a rack 16 formed upon an inner surface thereof, for moving upward or downward the door 12 in dependence on the revolution of a door motor 14, wherein the rack 16 is coupled to the door motor 14 through a pinion 18.

The discharge outlet 10 is provided at a lower portion thereof with a fist sensor 20 for detecting a descent of the door 12 or the opening of the discharge outlet 10, and a second sensor 22 for detecting an ascent of the door 12 or the closing of the discharge outlet 10. Both of sensors 20 and 22 constitutes door position detecting means as will be described later, for controllably adjusting up or down movement of the door 12.

Horizontal member 26 and vertical member 28 for adjusting blow direction of the discharged air from the discharge outlet 10 are installed in an inner side of the discharge outlet 10.

Figure 2:
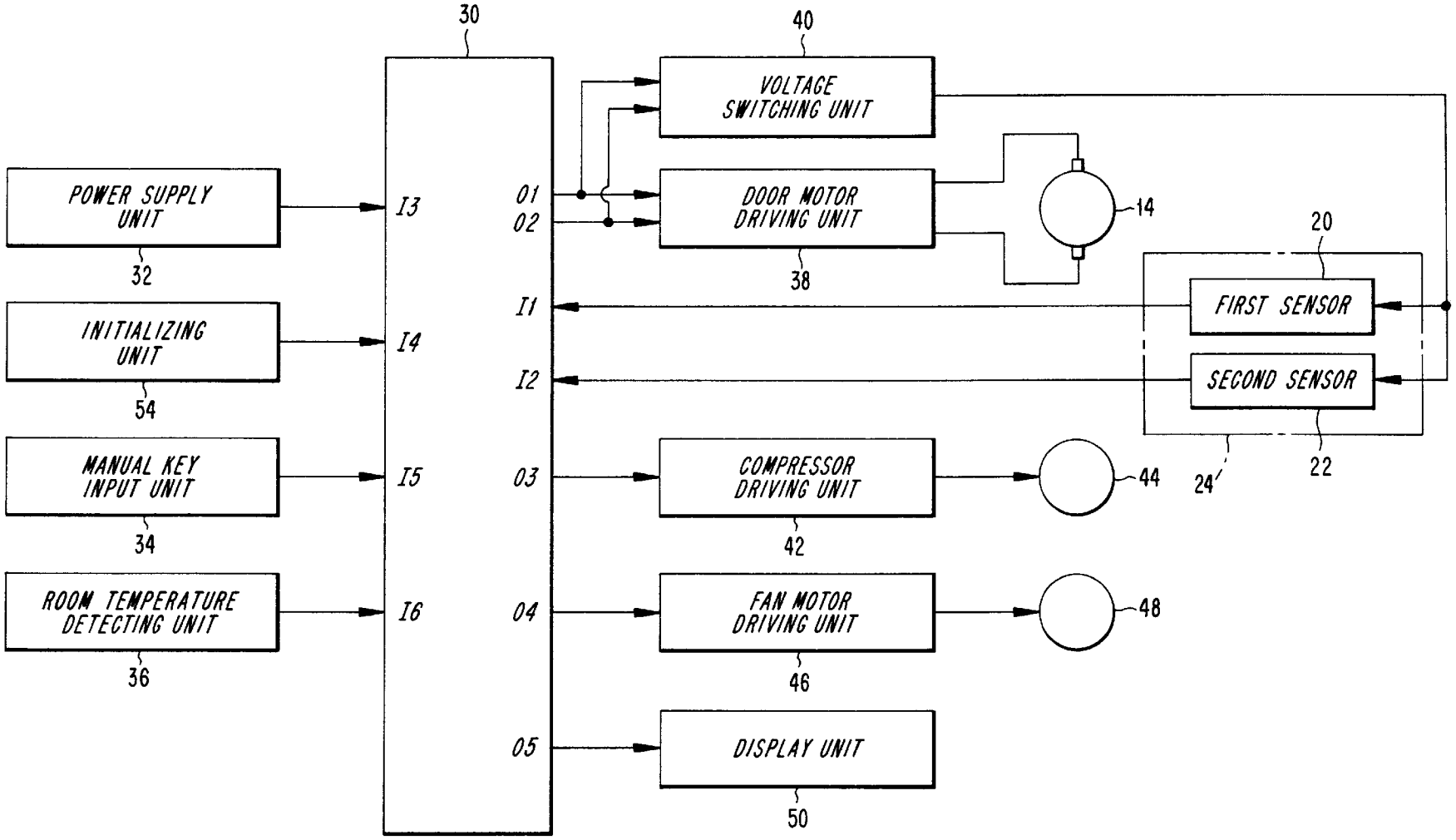
FIG. 2 is a control block diagram used in the air conditioner in accordance with the embodiment of the present invention.

FIG. 2 is a control block diagram of the air conditioner in accordance with the embodiment of the present invention, and FIG. 3 is a detailed circuit diagram of door motor driving means and voltage switching means in FIG. 2.

Figure 3A:
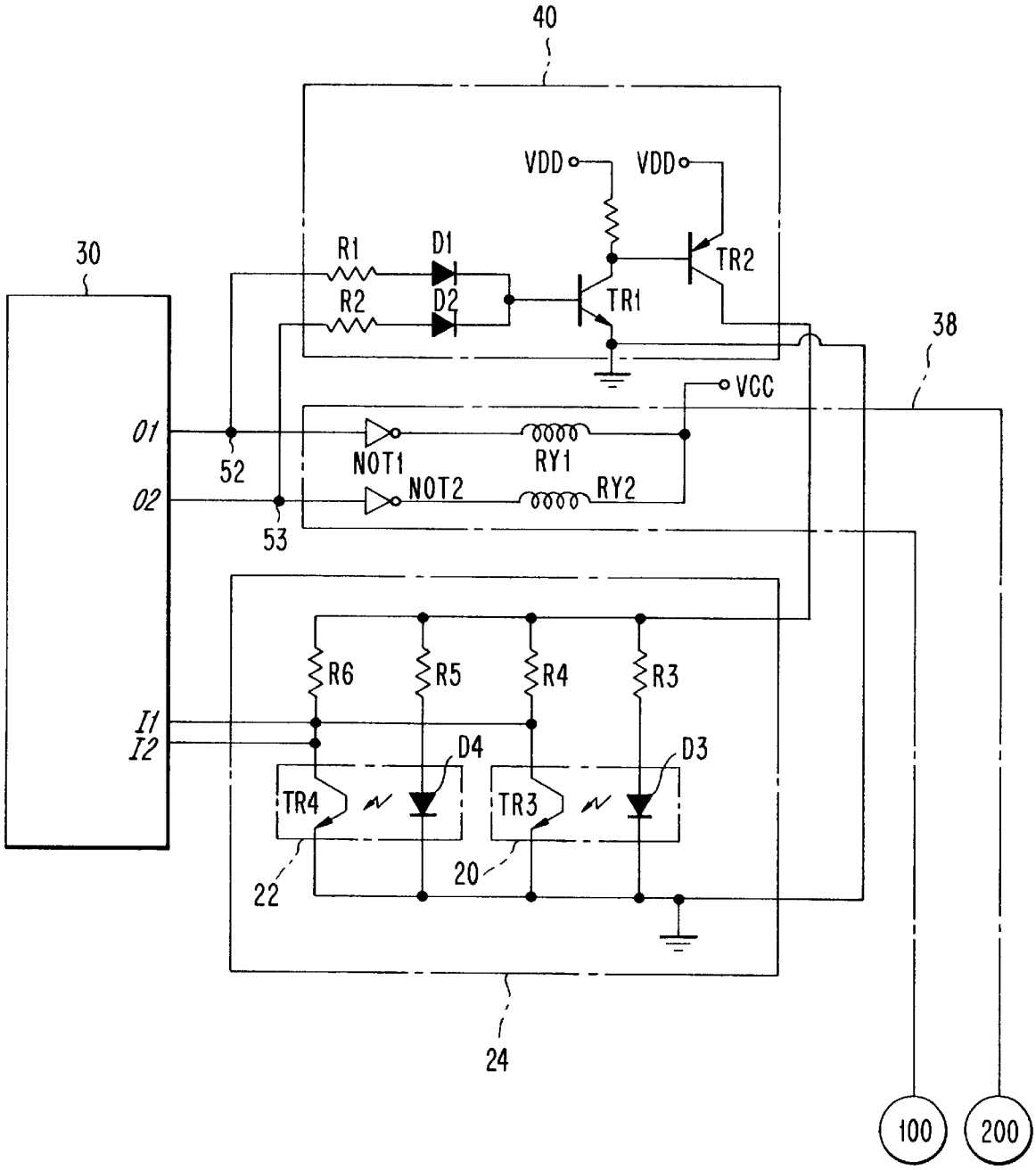
FIG. 3A and 3B show is a detailed circuit diagram of a voltage switching unit and a door motor driving unit in FIG. 2.
Figure 3B:
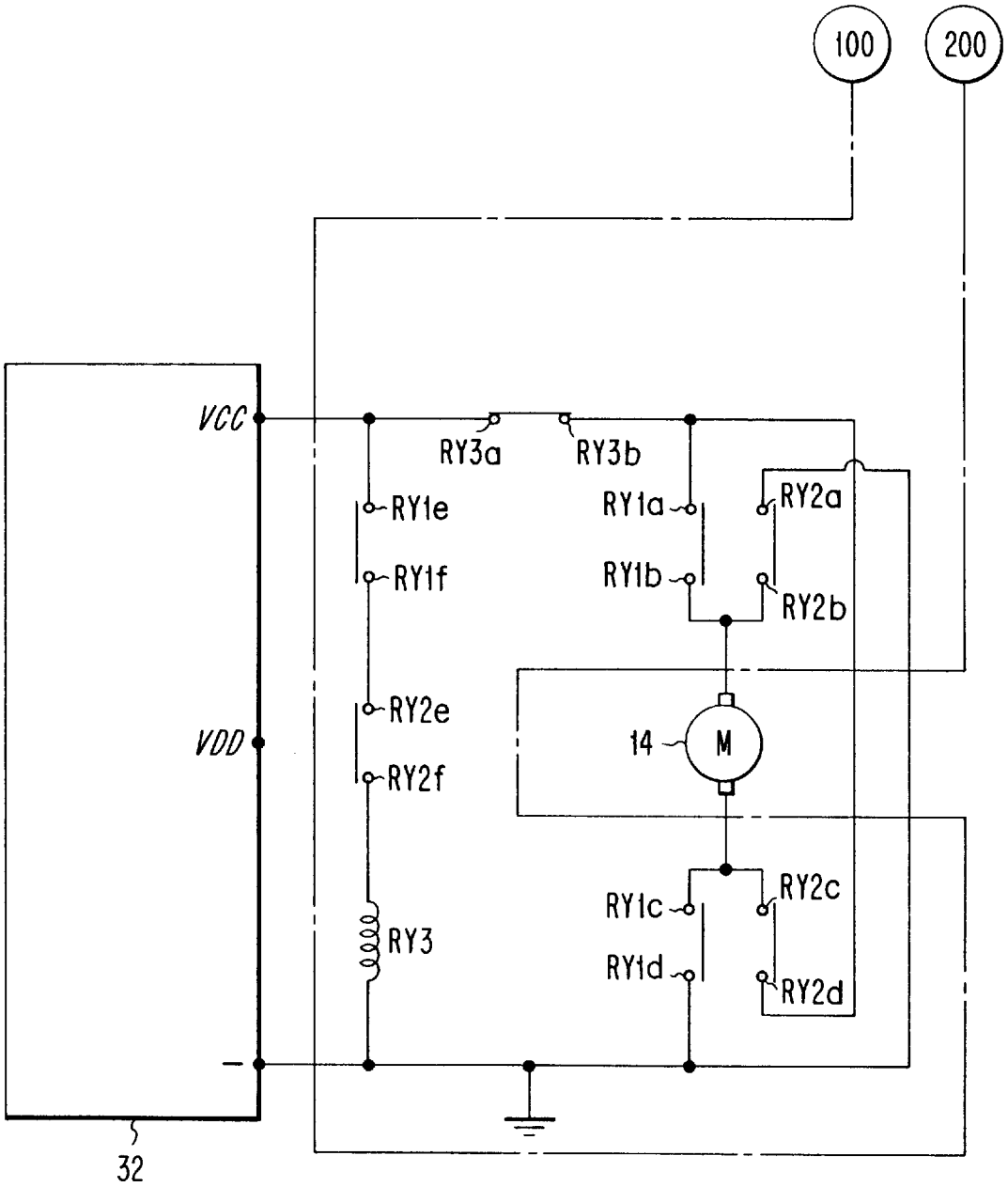

Referring to FIGS. 2, 3A and 3B, control means 30 may comprise a microprocessor, controls a general operation of the air conditioner.

Power supply means 32 serves to receive an electrical source voltage of commercial AC electrical power supplied from an external AC power source to convert the same to a predetermined DC voltage necessary for operation of the air conditioner and output the same to the control means and each of driving circuits.

Manual key input means 34 has a plurality of keys for applying control commands for operating the air conditioner into the control means 30.

Room temperature detecting means 36 serves to detect a temperature of the room air to be conditioned, and output the detection signal to the control means 30, which may comprise a well-known thermistor.

The door motor driving means 38, which is substantially switching circuit, serves to supply or shut off a voltage from the power supply means 32 to or from the door motor 14 such that the door motor 14 is driven or stops in response to the control signal issued from the control means 30, and to control polarities of the voltage applied from the power supply means 32 to the door motor 14 such that the door motor 14 is rotated in either a forward or reverse direction.

As shown in FIGS. 3A and 3B, the door motor driving means 38 includes a first relay RY1 for applying a DC voltage output from the power supply means 32 to the door motor 14 with a first polarity in response to the control signal for opening the discharge outlet 10 which is output an output terminal O1 of the control means 30, a second relay RY2 for applying a DC voltage output from the power supply means 32 to the door motor 14 with a second polarity opposite to the first polarity in response to the control signal for closing the discharge outlet 10 which is output an output terminal O1 of the control means 30, and a third relay RY3(see FIG. 3A) for shutting off the voltage applied to the door motor 14 for protecting the circuit in case both the first and second relays RY1 and RY2 are commonly energized.

The voltage switching means 40, which is substantially switching circuit, serves to connect an output terminal of the power supply means 30 to the door position detecting means 38 such that a driving voltage from the power supply means 32 is supplied to the door position detecting means 24 in case a door driving command control signal(or door driving enable signal) is output, and the means 40 also serves to electrically isolate the output terminal of the power supply means 30 from the door position detecting means 38 such that a driving voltage from the power supply means 32 is not supplied to the door position detecting means 24 in case a door driving stop command control signal(or door driving disable signal) is output.

As shown in FIGS. 3A and 3B, the above-mentioned voltage switching means 40 includes diodes D1, D2 connected to the control means 30 through the respective coupling nodes 52, 53 such that the diodes are turned on when a door driving enable signal from the control means 30 is output to the door motor driving means 38, while turned off when a door driving disable signal from the control means 30 is output to the door motor driving means 38, and transistors TR1, TR2 which are sequentially turned on or off in response to the on or off of both the diodes D1, D2, and then operated to supply or shut off a DC voltage from the power supply means 32 to or from the door position detecting means 24.

Referring to FIG. 2, compressor driving means 42, which is substantially switching and phase control circuit, is operated to control supply of an external AC voltage into the compressor 44 in response to the control signal from the control means 30, and to control the phase of the voltage applied from the external AC voltage to the compressor 44.

Fan motor driving means 46 is substantially switching circuit, which serves to control supply of the external AC voltage to the fan motor 48 for controlling the drive of the indoor fan 8 in response to the control signal from the control means 30.

Display means 50 is used for displaying operation states of the compressor 44 and fan motor 48 in response to the control signal, which may comprise a well-known liquid-crystal display panel and light emitting diodes.

In FIGS. 3A and 3B, the first sensor 20 outputs a discharge outlet opening command signal to an input terminal I1 of the control means 30 when down movement of the door 12 is completed, which comprises a photo-coupler having light emitting element and light receiving element.

Similarly, the second sensor 22 outputs a discharge outlet closing signal to an input terminal I2 of the control means 30 when ascending of the door 12 is completed, which comprises a photo-coupler having light emitting element and light receiving element.

Reference numeral 54 in FIG. 2 indicates initializing means.

Hereinafter, a method for controlling the air conditioner according to an embodiment of the present invention as constructed above with reference to FIG. 4.

For the purpose of explaining the method of the present invention, it is assumed as initial conditions that, in FIGS. 3A and 3B, the contacts RY1a and RY1b, RY1c and RY1d, and RY1e and RY1f of the first relay RY1 is opened, respectively.

Further assumption will be taken that the contacts RY2a and RY2b, RY2c and RY2d, and RY2e and RY2f of the second relay RY2 are also opened, respectively, while the contact RY3a and RY3b of the third relay RY3 is closed.

Further, it will be assumed that as shown in FIG. 1, the door 12 is positioned upstream of the indoor unit 2 to close the discharge outlet.

These assumptions means that the door motor 14 is at non-activated state.

Figure 4A:
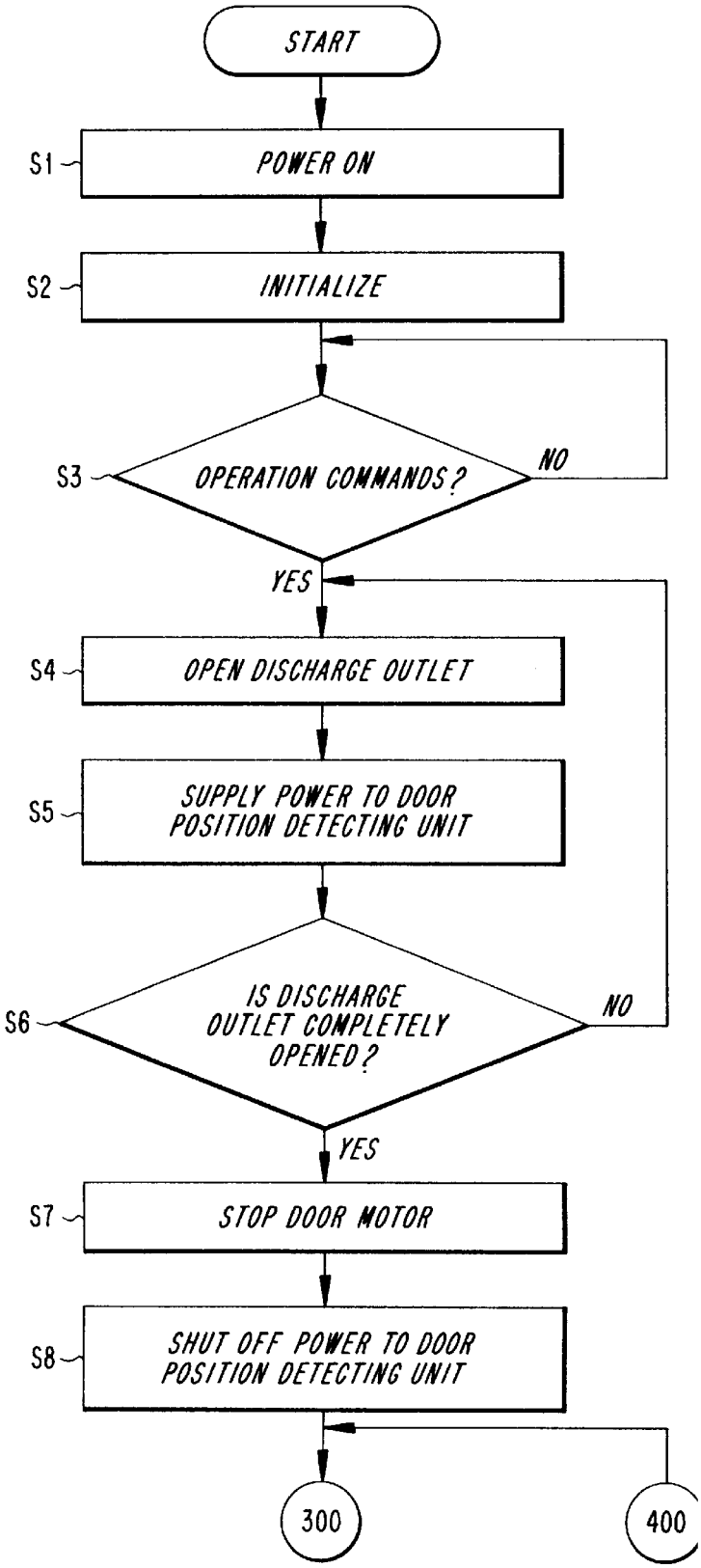
FIG. 4A to 4C are flow charts for illustrating sequential procedures for controlling the air conditioner in accordance with the present invention.
Figure 4B:
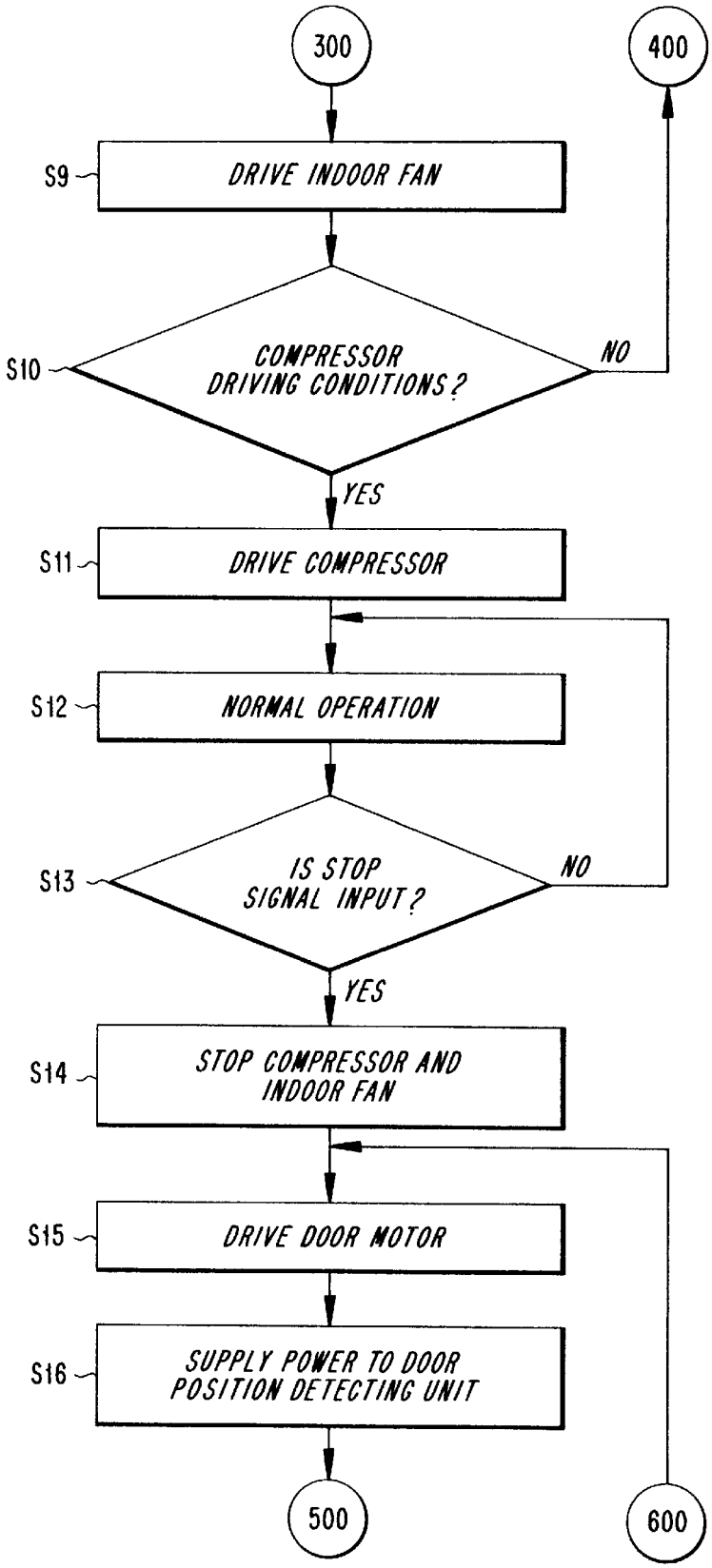
Figure 4C:
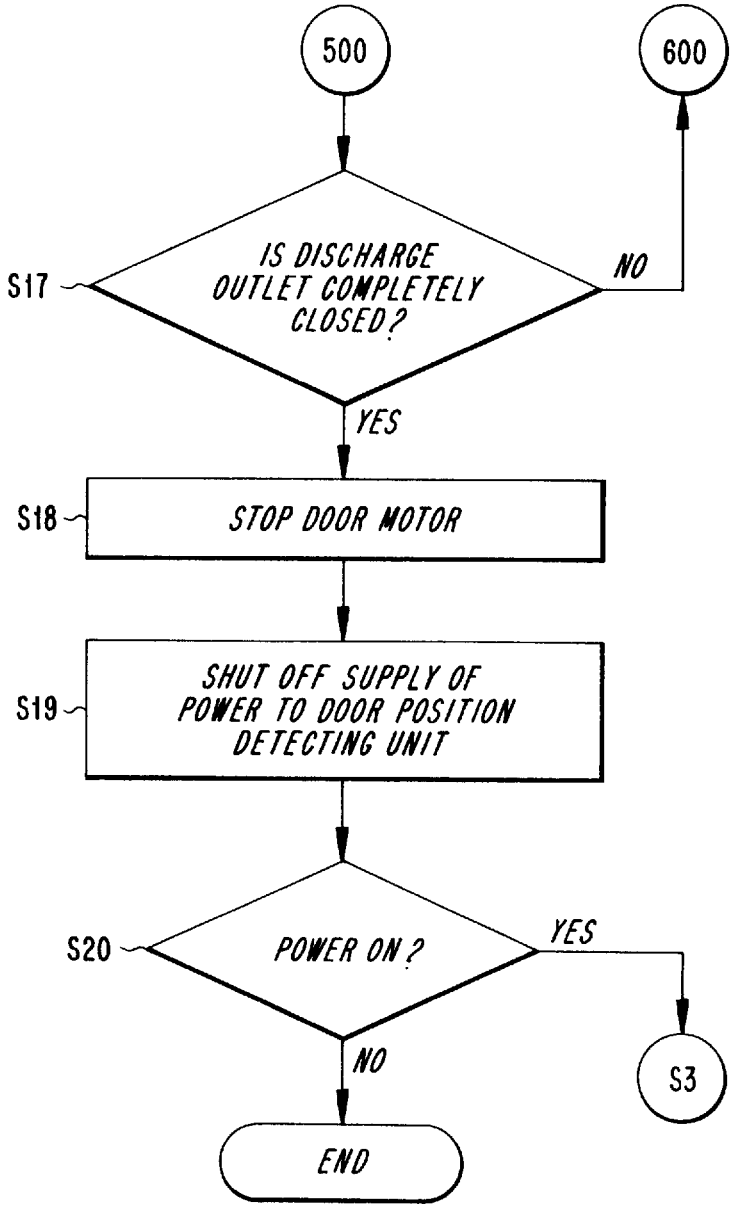

Referring to FIG. 4A, if a user puts a plug in the socket, an AC voltage of 220 V from an external power source is supplied to the power supply means 32, the compressor driving means 42 and the fan motor driving means 46.

The power supply means 32 receives an AC voltage to convert it to a DC voltage to be supplied through an output terminal VDD thereof to the control means 30, initializing means 54, manual key input means 34, room temperature detecting means 36 and display means 50. At the same time, the power supply means 32 commonly supplies a DC voltage of 5 V through the output terminal VDD thereof to a collector of a transistor TR1 and one end of a resistor R2 of voltage switching means 40. And, the power supply means 32 also outputs a DC voltage of 12 V through an output terminal VCC thereof to door motor driving means 38.

Next, at step S2, an initializing command signal from the initializing means 54 is applied to the control means 30 such that the control means 30, in response to the initializing command signal, initializes variables stored in a memory, not illustrated, of the control means 30 for the door closing/opening and air conditioning operations.

Then, at step S3, the control means 34 determines whether or not the commands such as the operation conditions and the operation start are issued through the manual key input means 34, and if not(in case of NO), the process waits for the above commands, else(in case of YES), advances to step S4.

At step S4, the control means 30 outputs through the respective output terminals O1 and O2 thereof high and low level signals to the door motor driving means 38 and the voltage switching means 40, respectively. The high level signal from the output terminal O1 is inverted to low level signal by an invertor NOT1 in the door motor driving means 38 to be applied to the first relay RY1 to which DC voltage of 12 V from the power supply means 32 is also supplied. In this manner, an energized relay RY1 allows three contacts thereof RY1a and RY1b, RY1c and RY1d, and RY1e and RY1f to be closed. At the same time, the low level signal from the output terminal O2 is inverted to high level signal by an invertor NOT2 in the door motor driving means 38 to be applied to the second relay RY2 to which DC voltage of 12 V from the power supply means 32 is also supplied. In this manner, an inactivated relay RY2 allows three contacts thereof RY2a and RY2b, RY2c and RY2d, and RY2e and RY2f to remain opened.

Then, the door motor 14 receives at input terminals 14*a*, 14*b* a DC voltage of 12 V from the power supply means 32 through contacts RY3a and RY3b of the 3rd relay RY3, and two contacts RY1a and RY1b, and RY1c and RY1d of the 1st relay RY1. Thus, the above door motor 14 rotates in a forward direction, which causes the pinion 18 to be correspondingly rotated in the same direction(counterclockwise direction in FIG. 1). Then, the rack 16 is lowered by the pinion 18, and the opening of the discharge outlet 10 starts.

Meanwhile, the high level signal output through the output terminal O1 of the control means 30 is also applied to the voltage switching means 40 in which transistor TR1 receives said high level signal through the resistor R1 and the diode D1. The transistors TR1 and TR2 are sequentially turned ON. Turning ON of the transistor TR2 means that both first and second sensors 20 and 22 are activated by supply of a DC voltage of 5 V through emitter and collector of the transistor TR2 of ON state.

With the activations of the first and second sensors 20 and 22, each of light emitting diodes D3 and D4 emits the respective light which each of light receiving transistors TR3 and TR4 adjacent to each of the diodes D3 and D4 receives. Each of the transistors TR3 and TR4 is then turned ON and outputs low level signals to input terminals I1 and I2, respectively, of the control means 30.

Next, at step S6, the control means 30 determines whether or not the moving discharge outlet has finished its excursion for a full open, based upon the signals from the first and second sensors 20 and 22. For the determination, the continued input to an input terminal I1 of the control means 30 as a low level signal from the first sensor 20 means that the discharge outlet 10 continues to be still opened, which corresponds to the result of NO at the decision step S6, thus returning to step S4 for continuing to move downward the door 12.

If it is determined at step S6, that the discharge outlet is completely opened with a full descent of the door 12 which causes a high level signal to be produced and applied to the input terminal I1 of the control means 30 (in case of YES at step S6), the process advances to step S7.

At step S7, low level signals from the output terminals O1, O2 of the control means 30 are output to the door motor driving means 38 and the voltage switching means 40, respectively. The low level signal output through the output terminal O1 is inverted to the high level signal through an invertor NOT1 of the door motor driving means 38, and then applied to the first relay RY1. Since the high level signal causes the electric current in the first relay RY1 not to be flown, the contacts RY1a and RY1b, RY1c and RY1d, and RY1e and RY1f of the first relay RY1 are opened. Thus, the suspension of supply of the power to the door motor 12 causes the door motor 12 to stop, consequently the pinion 18 and the rack 16 as well, so that the stationary of the door 12 is maintained.

Next, at step S8, the low level signal output through the output terminal O1 of the control means 30 is also applied to the transistor TR1 through the resistor R1 and diode D1. The transistors TR1 and TR1 are sequentially turned OFF. Turning OFF of the transistor TR2 means that both first and second sensors 20 and 22 are non-activated without supply of DC voltage of 5 V due to the transistor TR2 of OFF state.

Namely, the detection with the first and second sensors 20 and 22 for sensing the moved state of the door 12 is no longer made, for the door 12 has been completely moved downward to fully open the discharge outlet.

Then, at step S9, a fan motor driving control signal from the control means 30 is output to the fan motor driving means 46. In response to the control signal, AC voltage of 220 V from the fan motor driving means 46 is applied to the fan motor 48 to be rotated for circulating and heat-exchanging with the heat-exchanger 4 an indoor air.

Next, the control means 30 determines whether or not environmental conditions around the present indoor unit 2 meets the conditions for driving the compressor. If it is determined as being independent of the compressor driving conditions(in case of NO), the process waits.

If it is determined that an environmental condition is revealed to be, for example, of higher temperature than the pre-set temperature by a user with the detection of the room temperature detecting means 36, which corresponds to the compressor driving condition(in case of YES), the process advances to step S11.

At step S11, the control signal for driving the compressor from the control means 30 is output to the compressor driving means 42. In response to the control signal, AC voltage of 220 V from the fan motor driving means 46 is applied to the compressor 44 for compressing the refrigerant.

Next, during cooling or heating, at step S13, the control means 30 determines whether or not the stop signal from the manual key input means 34 is input, if not(in case of NO), the process returns to step S12 for normally performing cooling or heating. If the stop signal is input to control means 30(in case of YES), the process advances to step S14.

At step S14, the control means 30 outputs stop command signal for the compressor and fan motor to the compressor driving means 42 and the fan motor driving means 48, respectively. In response to the stop command signal, those means 42 and 46 does not apply the respective drive voltages to the compressor 44 and the fan motor 48, respectively. The stop of the fan motor 48 also allows the indoor fan 8 to stop, which means halt of air conditioning.

Next, at step S15, the control means 30 outputs through the respective output terminals O2 and O1 thereof high and low level signals to the door motor driving means 38 and the voltage switching means 40, respectively. The high level signal from the output terminal O2 is inverted to low level signal by an invertor NOT2 in the door motor driving means 38 to be applied to the second relay RY2 to which DC voltage of 12 V from the power supply means 32 is also supplied. In this manner, an energized relay RY2 allows three contacts thereof RY2a and RY2b, RY2c and RY2d, and RY2e and RY2f to be closed. At the same time, the low level signal from the output terminal O1 is inverted to high level signal by an invertor NOT1 in the door motor driving means 38 to be applied to the second relay RY1, whereby DC voltage of 12 V from the power supply means 32 is not applied to the relay RY1. In this manner, an inactivated relay RY1 allows three contacts thereof RY1a and RY1b, RY1c and RY1d, and RY1e and RY1f to remain opened.

Then, the door motor 14 receives at input terminals 14*a*, 14*b* a DC voltage of 12 V from the output terminal VCC of the power supply means 32 through contacts RY3a and RY3b of the 3rd relay RY3, and two contacts RY2a and RY2b, and RY2c and RY2d of the 2nd relay RY2. The above door motor 13 rotates in a reverse direction, which causes the pinion 18 to be also correspondingly rotated in the same direction(clockwise direction in FIG. 1). Thus, the rack 16 is lifted by the pinion 18, and the closing of the discharge outlet starts.

Subsequently, at step S16, the low level signal output through the output terminal O2 of the control means 30 is also applied to the voltage switching means 40 in which transistor TR1 receives said low level signal through the resistor R2 and the diode D2. The transistors TR1 and TR2 are sequentially turned ON. Turning ON of the transistor TR2 means that both first and second sensors 20 and 22 are activated by supply of a DC voltage of SV through emitter and collector of the turned ON transistor TR2.

With the activations of the first and second sensors 20 and 22, each of light emitting diodes D3 and D4 emits the respective light which each of light receiving transistors TR3 and TR4 adjacent to each of the diodes D3 and D4 receives. Each of the transistors TR3 and TR4 is then turned ON and outputs low level signals to input terminals I1 and I2, respectively, of the control means 30.

Next, at step S17, the control means 30 determines whether or not the moving discharge outlet has finished its excursion for a full close, based upon the signals from the first and second sensors 20 and 22. For the determination, the continued input to an input terminal I1 of the control means 30 as a low level signal from the second sensor 22 means that the discharge outlet continues to be still closed, which corresponds to the result of NO at the decision step S17, thus returning to step S15 for continuing to move upward the door 12.

If it is determined, at step S17, that the discharge outlet is completely opened with a full down movement of the door 12 which causes a high level signal to be produced and applied to the input terminal I1 of the control means 30(in case of YES), the process advances to step S18.

At step S18, low level signals from the output terminals O1, O2 of the control means 30 are output to the door motor driving means 38 and the voltage switching means 40, respectively. The low level signal output through the output terminal O2 is inverted to the high level signal through an invertor NOT2 of the door motor driving means 38, and then high level is applied to the second relay RY2. Since the high level signal causes the electric current in the second relay RY2 not to be flown, the contacts RY2a and RY2b, RY2c and RY2d, and RY2e and RY2f of the second relay RY2 are opened. Thus, the suspension of supply of the power to the door motor 14 causes the door motor 14 to stop, consequently the pinion 18 and the rack 16 as well, so that the stationary of the door 12 is maintained.

At the same time, at step S19, low level signals output through the output terminals O1, O2 of the control means 30 are applied to the transistor TR1 through the resistors R1, R2 and diodes D1, D2. The transistors TR1 and TR2 is sequentially turned OFF. Turning OFF of the transistor TR2 means that both first and second sensors 20 and 22 are non-activated without supply of DC voltage of 5 v due to the transistors TR2 of OFF state.

Namely, the detection with the first and second sensors 20 and 22 for sensing the moved state of the door 12 is no longer made, for the door 12 has been completely moved upward to fully close the discharge outlet.

Then, at step S20, the control means 30 determines whether or not AC voltage of 220 V from a present external AC power source is supplied to the power supply means 32. In case the level of the voltage supplied to the control means 30 from the power supply means 32 is below a predetermined level, it is determined as an absence of the desired AC voltage(in case of NO), thus the present control program for air conditioning and door closing/opening is finished. However, in case the level of the voltage supplied to the control means 30 from the power supply means 32 is above a predetermined level, it is determined that the desired AC voltage of 220 V is available from the external AC voltage (in case of YES), then the process jumps to step S3, again for performing the subsequent steps according to the forgoing description, based upon the determination as to the input of the operation command signal including the operation conditions and start command signals to the control means 30 through the key input means 34.

According to the air conditioner and method therefor of the present invention, a reduced power consumption of the product, a prolonged life time of the parts, easier maintenance and the prevention of malfunction of the product can be effected with the selective supply of the driving voltage to the door position detecting means for detecting the position of the door provided for closing or opening the discharge outlet.

What is claimed is:

1. An air conditioner having an intake inlet for taking in indoor air, a heat-exchanger for heat-exchanging the indoor air, a discharge outlet formed to discharge heat-exchanged air, and a discharge outlet door that is closable for preventing dusts or foreign substances from passing through the discharge outlet when the air conditioner is in a stand-by mode, and which outlet door is openable for discharging the heat-exchanged air when the air conditioner is in operation, the air conditioner comprising:

control means for generally controlling air conditioning;

door motor driving means for controlling a door motor drive such that, in response to a control signal from the control means, the outlet door is moved upward or downward to open or close a discharge outlet;

door position detecting means for detecting a current position of the outlet door and for providing a detection signal to the control means;

voltage switching means for controlling a driving voltage to be supplied to the door position detecting means in response to detection of one of a fully up and fully down states of the outlet door.

2. The air conditioner as claimed in claim 1, wherein the voltage switching means comprises a plurality of relays which are closed or opened for connecting and disconnecting the door position detecting means, thereby supplying the driving voltage to the door position detecting means during movement of the discharge outlet door, and to shut off supply of the driving voltage to the door position detecting means when the discharge outlet door is in a stationary state.

3. The air conditioner as claimed in claim 1, wherein the voltage switching means comprises:

first and second diodes connected to the control means and a coupling node of the door motor driving means, respectively, such that the first and second diodes are turned on when a door driving enable signal from the control means is output to the door motor driving means and turned off when a door driving disable signal from the control means is output to the door motor driving means; and first and second transistors which are sequentially turned on and off in response to the on and off states of the first and second diodes and then operated to supply or shut off a DC voltage from a power supply means to the door position detecting means.

4. A method conditioning air, the method comprising the steps of:

initializing an air conditioner;

opening a discharge outlet in the air conditioner in response to an operation command input to the air conditioner;

applying a driving voltage to an outlet door position detecting means for detecting the state of the outlet door during a movement of the door;

shutting off a supply of the driving voltage to the door position detecting means in the event of suspension of the door motor drive that occurs when the discharge outlet is fully opened;

performing an air conditioning in response to pre-set air conditioning conditions;

closing the discharge outlet by moving the door using the door motor drive when air conditioning is finished; and entering a stand-by state after shutting off the driving voltage provided to the door position detecting means in the event of suspension of the door motor drive that occurs when the discharge outlet is fully closed.

5. In an air conditioner that includes a discharge outlet, an apparatus for controlling a discharge outlet door, the apparatus comprising:

control means for controlling air conditioner operations;

driving means for controlling a door driving motor in response to a signal from the controller to move the discharge outlet door between open and closed positions;

door position detecting means for detecting the position of the discharge outlet door, and for providing a position signal to the control means; and a switching means for controlling a supply of voltage to the door position detection means in response to the signal from the controller to move the discharge outlet door between open and closed positions.

6. The apparatus according to claim 5, wherein the switching means shuts off the supply of voltage to the door position detection means in the event that the discharge outlet door is fully opened.

7. The apparatus according to claim 6, wherein the switching means shuts off the supply of voltage to the door position detection means in response to suspension of operation of the door driving motor.

8. The apparatus according to claim 5, wherein the switching means shuts off the supply of voltage to the door position detection means in the event that the discharge outlet door is fully closed.

* * * * *